US006382149B1

(12) United States Patent
Fischer et al.

(10) Patent No.: US 6,382,149 B1
(45) Date of Patent: May 7, 2002

(54) VALVE TIMING SYSTEM FOR AN INTERNAL COMBUSTION ENGINE

(75) Inventors: Gert Fischer, Feldafing; Michael Bidlingmaier, Munich; Johannes Hoehl, Maisach, all of (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/701,874

(22) PCT Filed: May 7, 1999

(86) PCT No.: PCT/EP99/03154

§ 371 Date: Feb. 5, 2001

§ 102(e) Date: Feb. 5, 2001

(87) PCT Pub. No.: WO99/64729

PCT Pub. Date: Dec. 16, 1999

(30) Foreign Application Priority Data

Jun. 5, 1998 (DE) ..... 198 25 307

(51) Int. Cl.[7] ..... F01L 1/34

(52) U.S. Cl. ..... 123/90.16; 123/90.17; 123/90.27; 123/90.39; 123/90.48

(58) Field of Search ..... 123/90.16, 90.15, 123/90.17, 90.24, 90.27, 90.33, 90.39, 90.41, 90.42, 90.44, 90.48, 90.5, 196 R

(56) References Cited

U.S. PATENT DOCUMENTS 5,515,819 A * 5/1996 Groh et al. ..... 123/90.16
5,690,067 A * 11/1997 Reckzugel ..... 123/90.16
5,732,669 A * 3/1998 Fischer et al. ..... 123/90.16
5,899,180 A * 5/1999 Fischer ..... 123/90.16
5,992,361 A * 11/1999 Murata et al. ..... 123/90.17
6,135,075 A * 10/2000 Boertje et al. ..... 123/90.16
6,145,485 A * 11/2000 Bidlingmaier et al. ... 123/90.16
6,276,320 B1 * 8/2001 Fujii et al. ..... 123/90.16
6,293,238 B1 * 9/2001 Harmon ..... 123/90.16
6,311,659 B1 * 11/2001 Pierik ..... 123/90.24
6,314,926 B1 * 11/2001 Meneely et al. ..... 123/90.16

FOREIGN PATENT DOCUMENTS

| | | |
|---|---|---|
| DE | 30 41 864 | 5/1982 |
| FR | 889861 | 1/1944 |
| GB | 1 311 562 | 3/1973 |
| GB | 2 214 567 | 9/1989 |
| WO | WO 94/13935 | 6/1994 |

* cited by examiner

*Primary Examiner*—Teresa Walberg
*Assistant Examiner*—Fadi H. Dahbour
(74) *Attorney, Agent, or Firm*—Crowell & Moring LLP

(57) ABSTRACT

A valve timing gear of an internal-combustion engine is provided, in the case of which a camshaft acts by a timing cam upon a valve by way of a tappet whose cam-side contact path can be changed by a control device for changing the valve opening period. For achieving a small-sized control device, this control device comprises a slider rocker guided in the valve lifting direction by way of a first sliding hinge joint arranged on an engine section side and an additional sliding hinge joint provided on the tilting segment side, with a control opening penetrated with play by a timing-cam-free section of the camshaft. An element, which can be operated in a controlled manner, of an adjusting device is arranged in/on the camshaft, while rotating with it, and being applied such to the circumference of the control opening that the adjustable slider rocker, while the camshaft is rotating, carries out for each valve lift a periodic rocking movement which is used for forcibly controlling the tilting segment.

16 Claims, 5 Drawing Sheets

VALVE TIMING SYSTEM FOR AN INTERNAL COMBUSTION ENGINE

BACKGROUND AND SUMMARY OF THE INVENTION

According to the preamble of claim 1, the invention relates to a valve timing gear for an internal-combustion engine, in which a timing cam of a camshaft acts by way of a tilting segment in a tappet in a timing manner upon a lifting valve, the tilting segment constructed with a contact path acted upon by the timing cam being arranged in a movably guided manner such by way of a circular-arc-shaped section concentric to the axis of rotation of the camshaft in the tappet that, by means of a control device during each valve lift an engagement of the contact path with the flanks of the rotating timing cam, which engagement determines the opening and closing phase of the lifting valve, is achieved by a swivelling movement of the tilting segment which is forcibly controlled in the same direction and/or in the opposite direction relative to the rotating direction of the timing cam.

The above-described valve timing gear is the object of European Patent Document EP 0 626 035 B1, in which, by means of the valve timing gear described in that document, in the case of an internal-combustion engine, at lower rotational speeds, small valve opening angles with a low or small overlap and, at high rotational speeds, large valve opening angles with much overlap of the inlet and outlet valve lift curves are achieved for forming high gas dynamics. Inlet and outlet valve lift curves corresponding to a timing cam, by means of the invention, can be changed correspondingly in the case of an intermediate element or tilting segment controlled in the same direction synchronously to the respective timing cam in the direction of large valve opening angles and, in the case of an intermediately element or titling segment synchronously controlled in the opposite direction, can be changed correspondingly in the direction of small valve openings angles.

As further illustrated in the drawings of that document, each of the illustrated and described valve timing gears is combined with a control device which in each case comprises a control shaft arranged in the transverse direction of the internal-combustion engine laterally of the respective camshaft. In connection with the transmission members transmitting the control movements of the control shaft to the respective intermediate elements, an additional space requirement occurs in the cylinder head of the internal-combustion engine which, for example, does not exist in the case of a defined valve angle or results in a wider cylinder head.

It is an object of the invention to improve the valve timing gear of this type such that it can be arranged independently of the given space conditions in a specifically given cylinder head under a cylinder head cover which is maintained unchanged.

This object is achieved by means of Claim 1, specifically in that the control device comprises a slider rocker which is guided in the valve lifting direction by way of a first sliding hinge joint arranged on the engine section side and another sliding hinge joint provided on the tilting segment side and which has a control opening which is penetrated with play by a timing-cam-free section of the camshaft, an element, which can be operated in a controlled manner, of an adjusting device arranged in/on the camshaft while rotating with it being applied such to the circumference of the control opening that the slider rocker, which can be adjusted in the valve lifting direction with the control opening eccentrically to the axis of rotation of the camshaft, while the camshaft is rotating, carries out for each valve lift a periodic rocking movement which is used for forcibly controlling the tilting segment and takes place transversely to the valve lifting direction with a superimposition with a sliding movement caused in the valve lifting direction.

For a valve timing gear having lifting valves operated by way of tappets, by means of the invention, a small-sized control device is advantageously achieved for changing the valve opening angles in a manner which reduces the required space, in that the control shaft or another equally acting adjusting device with the pertaining adjusting means are arranged in and around the camshaft in a close vicinity for the periodic rocking drive of a slider rocker which acts upon the respective tilting segment in a driving manner and which is preferably guided on the other side of the camshaft by way of a sliding hinge joint on an oil supply pipe fixed on adjacent camshaft bearing covers.

In another embodiment, this slider rocker arranged in a rockingly and slidably guided manner within a given cylinder head contour, preferably within the projection of a camshaft driving wheel, has a control opening which is closed on its circumference and is designed radially symmetrically with a cylindrical circumference, for achieving advantageously symmetrical valve lift courses. As a result of the corresponding design of the control opening, as required, asymmetrical valve lift courses are also conceivable.

A constructionally and kinematically advantageous embodiment of the invention is described in additional subclaims.

The advantageously small-sized control device according to the invention kinematically has the advantage of a continuous change of the opening angle, in which case, even in the case of small opening angles, large valve lifts are achieved with a relatively low migration of the contact line between the cam and the contact path of the tilting segment. Furthermore, advantageously the same cylinder head can be used for a valve timing gear with the control device according to the invention and for a valve timing gear without this control device, in which case, particularly when a valve timing gear is used which has two adjacent lifting valves of the same time while no control device is provided, no unnecessary and empty constructional volume is carried along. Finally, a valve timing gear with the control device according to the invention can also be equipped with an angle-of-rotation adjusting device for spreading the timing cams.

Because of the low oscillating mass, the special advantage of the control device according to the invention is its suitability for high-revving internal-combustion engines.

The invention will be described by means of a preferred embodiment illustrated in the drawings.

DETAILED DESCRIPTION OF THE DRAWINGS

Figure 1:
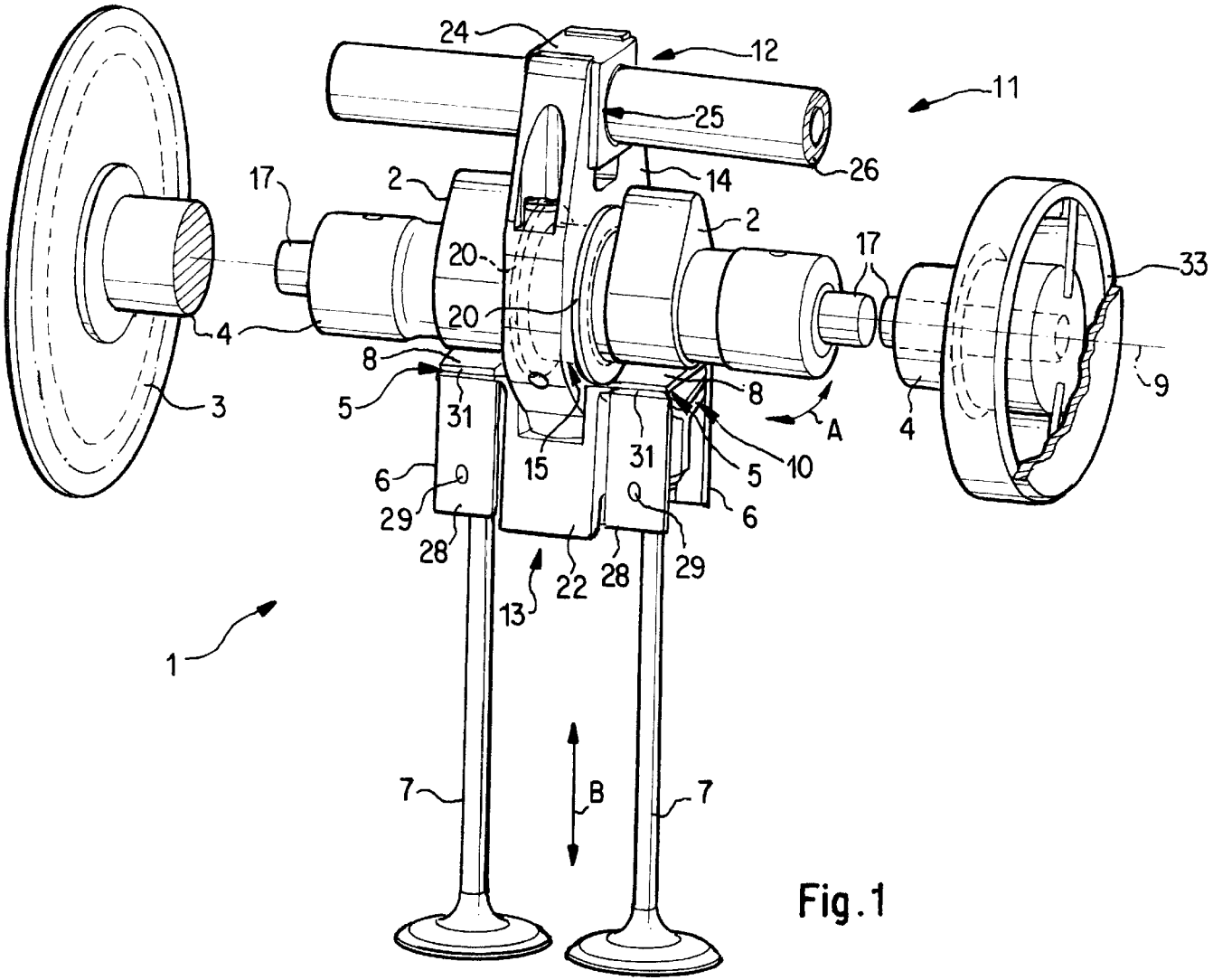
FIG. 1 is a cutout-type view of a valve timing gear having two lifting valves of the same type with a control device which affects both jointly and whose control shaft is connected on one end of the camshaft with a rotation adjusting device and the camshaft is equipped on the other end at least with a driving wheel.

In the case of a valve timing gear 1, as shown in FIG. 1, for an internal-combustion engine, which is not shown, a timing cam 2 of a camshaft 4 connected with a driving wheel 3 acts by way of a tilting segment 5 in a tappet 6 in a timing manner upon a lifting valve 7, the tilting segment 5 constructed with a contact path 8 acted upon by the timing cam 2 being arranged in a movably guided manner by way of a circular-arc-shaped section 10 concentric to the axis of rotation 9 of the camshaft in the tappet 6. By means of a control device 11, which is in a driving connection with the tilting segment 5, during each valve lift, an engagement of the contact path 8 with the flanks of the rotating timing cam 2, which engagement determines the opening and closing phase of the lifting valve 7, is achieved by a swivelling movement according to arrow "A" of the tilting segment which is forcibly controlled in the same direction and/or in the opposite direction relative to the rotating direction of the timing cam 2.

For the further development, corresponding to the object, of the valve timing gear 1 disclosed in European Patent Document 0 626 035 B1 to the extent that this valve timing gear 1 can be arranged independently of the given space conditions in a specifically given, not shown cylinder head under a cylinder head cover which is maintained unchanged, a modified control device 11 is suggested according to the invention.

The control device 11 according to the invention comprises a slider rocker 14 which is guided in the valve lifting direction according to arrow "B" by way of a first sliding hinge joint 12 arranged on the engine section side and another sliding hinge joint 13 provided on the tilting segment side and which has a control opening 15 which is penetrated with clearance by a timing-cam-free section of the camshaft 4, an element, which can be operated in a controlled manner, of an adjusting device 16 arranged in/on the camshaft 4, while rotating with it, being applied to the circumference of the control opening 15 such that the slider rocker 14, which can be adjusted in the valve lifting direction according to arrow "B" with the control opening 15 eccentrically to the axis of rotation 9 of the camshaft, while the camshaft 4 is rotating, carries out for each valve lift a periodic rocking movement according to arrow "A" which is used for forcibly controlling the tilting segment 5 and takes place transversely to the valve lifting direction according to arrow "B" with a superimposition with a sliding movement caused in the valve lifting direction according to arrow "B".

Figure 7:
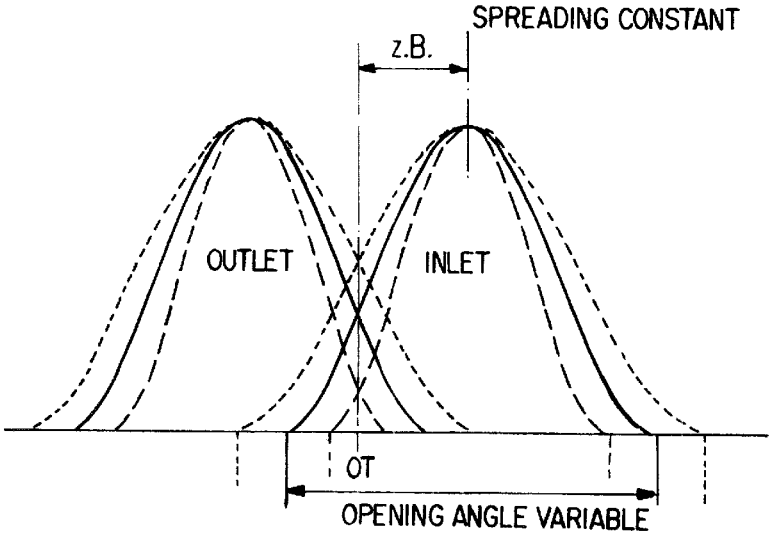
FIG. 7 is a view of lifting curves for inlet and outlet valve at changed opening and closing points in time achieved by means of the valve timing gear according to the invention.

For achieving preferred symmetrical lifting courses according to FIG. 7, the control opening 15 in the slider rocker 14 is designed radially symmetrically with a cylindrical circumference.

Figure 2:
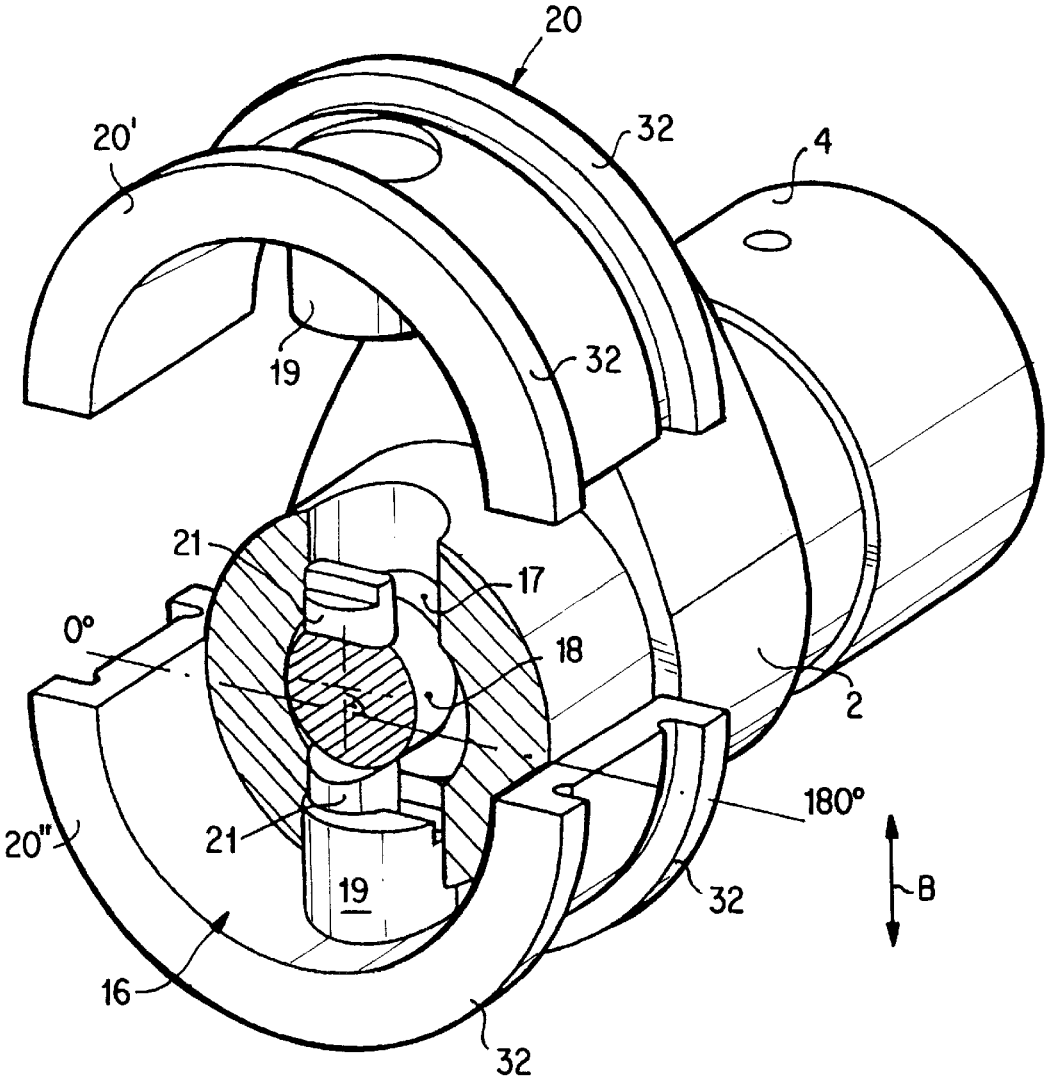
FIG. 2 is a perspective sectional view of the camshaft with the control shaft disposed therein and additional elements of the pertaining adjusting device with a guide ring guided in the slider rocker.

An adjusting device 16, as shown in FIG. 2 of the control device 11, which advantageously requires little space, comprises a control shaft 17, which is coaxially rotatably arranged in a hollow camshaft 4, with an eccentrically arranged control pin 18 per slider rocker 14, the control pin 18 interacting with adjusting pins 19 which are arranged in the camshaft in a diametrically radially movably guided manner, each of which adjusting pins 19 being in a fixed connection with half a section 20', 20" of a guide ring 20 rotatably disposed in the control opening 15 of the slider rocker 14. In this adjusting device 16, this guide ring 20 forms the above-described element which can be operated in a controlled manner and which is applied to the circumference of the control opening 15.

If, during the direct interaction between the control pin 18 and the adjusting pin 19, a line contact is to be avoided, according to the invention, one sliding block 21 respectively can be arranged between the control pin 18 and each adjusting pin 19, each sliding block 21 interacting with the control pin 18 as well as with the respective face of the adjusting pin 19 by way of correspondingly adapted sliding surfaces in a form-locking and therefore flat manner.

Figure 4:
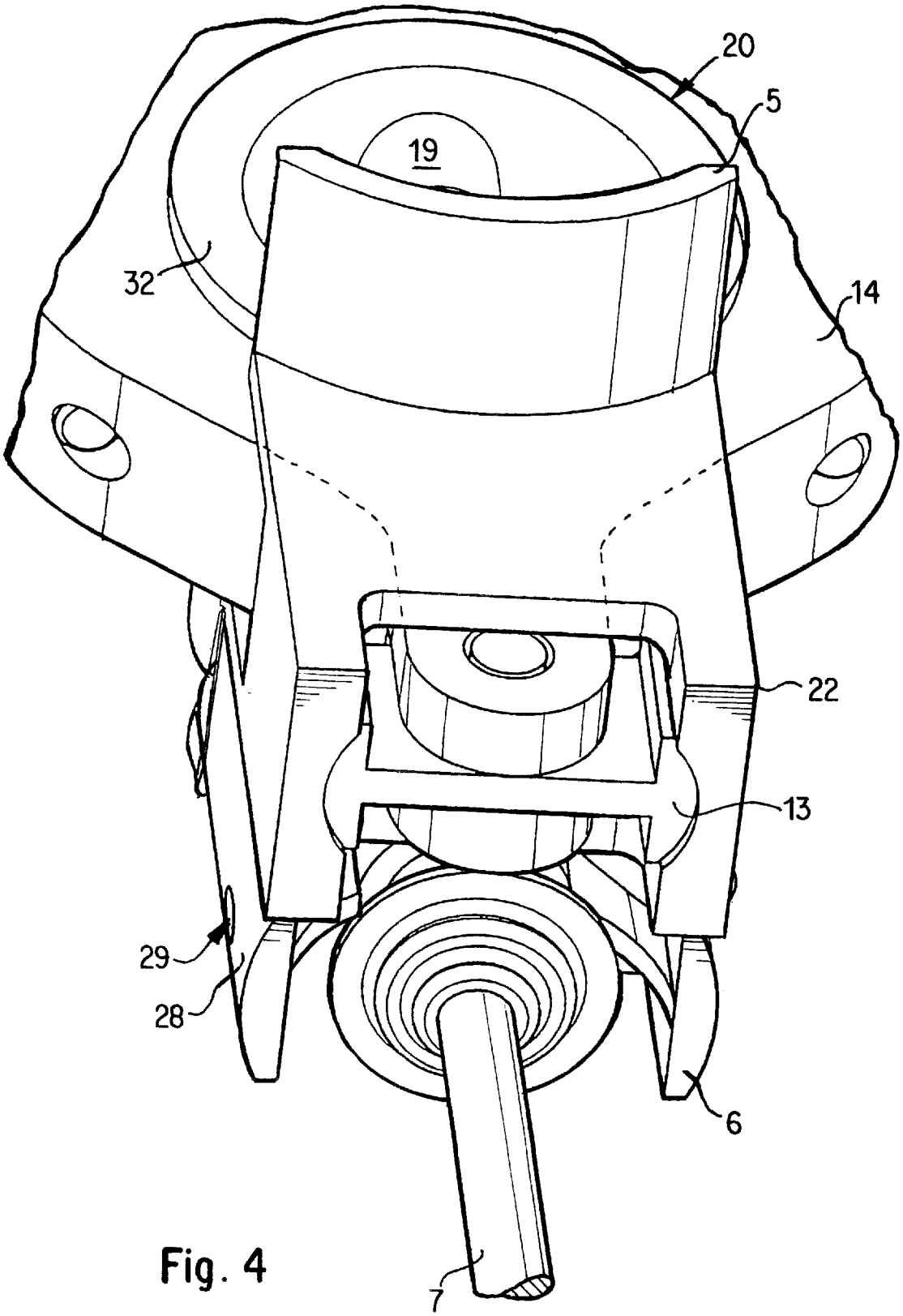
FIG. 4 is a perspective view of the pendulum rocker from below with a slider rocker illustrated in sections and linked to the tilting-segment-side sliding hinge joint.
Figure 5:
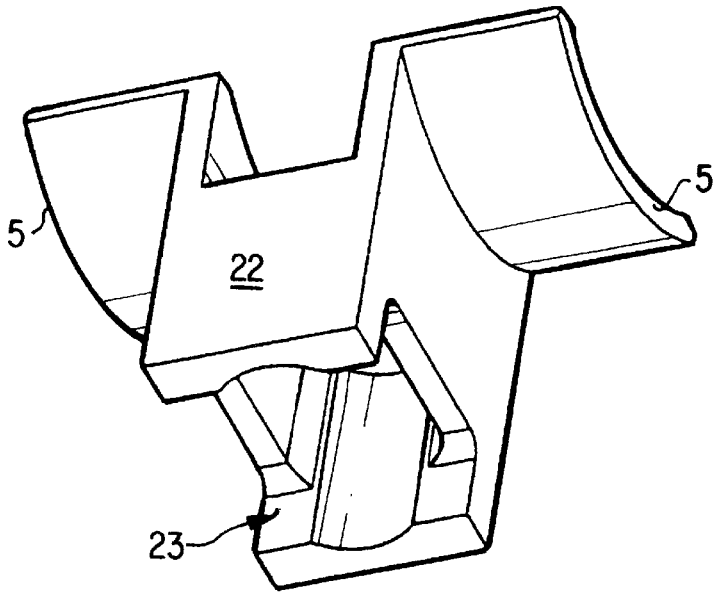
FIG. 5 is a perspective detailed view of the pendulum rocker.

A control device 11 according to the invention which requires advantageously low constructional expenditures is achieved particularly in that, in the case of adjacent lifting valves 7 of the same type whose tilting segments 5 disposed in the tappets 6 are connected with a pendulum rocker 22 arranged between the tappets 6, in which case the pendulum rocker 22 guided in a rocking manner by way of the tilting segments 5 in a shaft 23, as shown in FIG. 5, is equipped with a straight-guided tilting-segment-side sliding hinge joint 13, to which the slider rocker 14 which both lifting valves 7 have in common is applied in a hinged manner according to FIGS. 1 and 4.

Additionally reduced expenditures while using existing elements are also achieved by means of the control device 11 according to the invention in that, in the other end area, in the valve lifting direction according to the arrow "B", on the other side of the camshaft 4, the slider rocker 14 is in a movable connection by way of a fork-type alignment with a sliding block 24 of the engine-section-side sliding hinge joint 12, in which case the sliding block 24 is angularly movably disposed by way of a bearing bush 25 on an oil supply pipe 26 fixed on camshaft bearing covers which are not shown.

This arrangement advantageously permits that the alignment with the sliding block 24 of the slider rocker 14 as well as the bearing of this sliding block 24 on the bearing bush 25 is lubricated by means of oil from the oil supply pipe 26.

Figure 3:
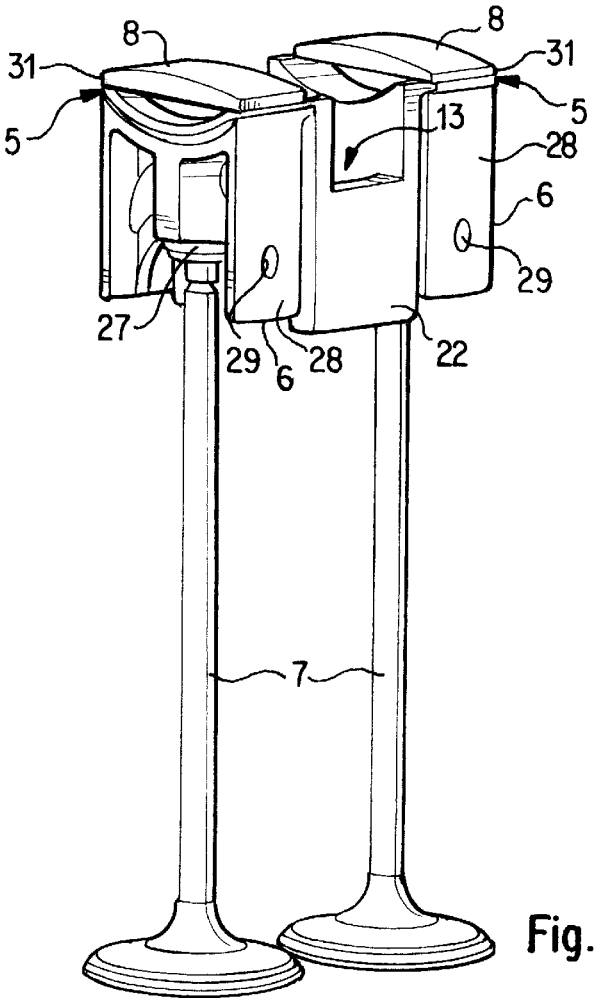
FIG. 3 is a perspective view of the lifting valves of the same type with box tappets whose tilting segments are connected with a common pendulum rocker.
Figure 6:
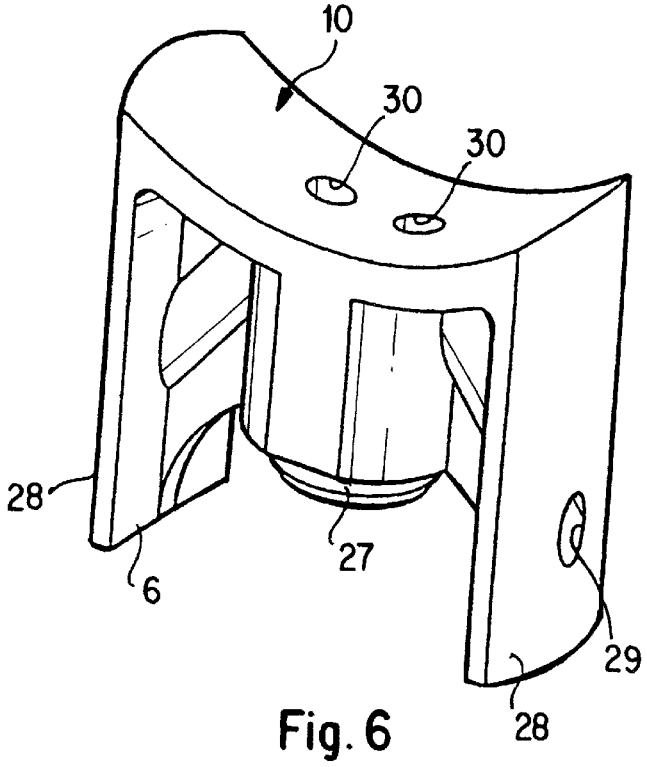
FIG. 6 is a view of a box tappet with openings in the circular-arc section of the oil supply ducts for the HVA.

As illustrated particularly in FIGS. 1, 3 and 6, the lifting valves 7 of the same type are actuated by way of box tappets 6 by means of hydraulic valve play compensating elements or HVA 27, in which case, oil supply ducts 29 provided from the oppositely arranged guiding surfaces 28 of each box tappet 6 to the respective HVA 27 are extended beyond the HVA to respective mouths 30 in the circular-arc section 10 which receives the tilting segment 5 in a bearing manner. This arrangement advantageously achieves a simple lubrication of the tilting segments 5 in the box tappets 6.

With respect to the constructional further development, each tilting segment 5 can be designed in one piece with a respective contact path or may have a contact path 8 constructed on a separate part 31, the separate part 31 being in a detachable connection, such as a plug-type connection, with the tilting segment.

As a further development according to the invention of the control device 11, the slider rocker 14 has a divided construction in the area of the control opening 15, for receiving a guide ring 20, which is constructed with radial flanges 32 and by means of which the slider rocker 14 is secured in its position in the axial direction relative to the camshaft 4 in an advantageously simple manner. For lubricating the guide ring 20 in the control opening 15, a lubrication bore is provided in the slider rocker 14 and is extended beyond the lubricating area of the alignment/sliding block 24 of the engine-section-side sliding hinge joint 12, for feeding oil from the oil supply pipe 26.

For increasing the variability of the valve timing gear 1, the camshaft 4 can be provided at one end with an angle-of-rotation adjusting device provided in the area of the driving wheel 3, for changing the spread between the inlet and outlet cams. On the other end of the camshaft 4, a rotation adjusting device 33 for the control shaft 17 is provided, which permits a continuous rotation adjustment of the control shaft 17 from 0° to 180° or <180° and back. This rotation adjusting device 33 can be designed, for example, in the manner of a vane cell pump and can be hydraulically controlled.

With reference to FIG. 7, the continuously drawn inlet and outlet valve lifting curves are generated by the respective timing cams 2 while the control device 11 is controlled to be inoperative. The guide ring 20 in the slider rocker 14, by way of the control pin 18 of the control shaft 17 arranged concentrically in the camshaft 4, being coaxially arranged with respect to the axis of rotation 9 of the camshaft 4. In this case, in one of the end positions on a straight line extending transversely to the valve lifting direction "B", the control pin 18 is in the 0° or 180° position.

For achieving a valve lifting curve with an enlarged opening angle according to the dotted valve lifting curves in FIG. 7, each tilting segment 5 is controlled such by means of the control device 11 that each tilting segment 5 is moved relative to the rotating direction of the timing cam 2 for the opening area in the opposite direction and for the closing area in the same direction. In this case, a valve lifting curve with a maximal opening angle is achieved in that the control pin 18 of the control shaft 17 is rotated by way of its rotation adjusting device 33 by an angle of 90° out of the respective 0°-position or 180°-position, the control pin 18 being adjusted over the straight line of the 0°- and the 180°-position extending transversely to the valve lifting direction "B" in the direction of the engine-section-side sliding hinge joint 12 of the slider rocker 14.

In the case of a valve lifting course with a minimal opening angle according to one of the broken valve lifting curves of FIG. 7, the control pin 18 is controlled into a diametrical position to the position below the above-mentioned straight line relevant to the maximal opening angle. By means of this selected position of the control pin 18, it is initiated by way of the control device 11 that the respective tilting segment 5 in the opening area is first moved along into the rotating direction of the timing cam 2 for achieving a later opening point and that then, in the closing phase of the lifting valve 7, the tilting segment 5 is moved into the opposite direction for achieving an earlier closing point.

Because of the advantageous kinematic construction, the control device 11 according to the invention has the advantage of a continuous change of the opening angle between its maximal and minimal value and a correspondingly high number of intermediate valve lifting curves.

What is claimed is:

1. Valve timing gear for an internal-combustion engine, comprising a timing cam of a camshaft acting by a tilting segment in a tappet in a timing manner upon a lifting valve, the tilting segment being constructed with a contact path acted upon by the timing cam and arranged in a movably guided manner by a circular-arc section concentric to the axis of rotation of the camshaft in the tappet such that, by a control device, during each valve lift, an engagement of the contact path with flanks of the rotating timing cam determining an opening and closing phase of the lifting valve and being achieved by a swivelling movement of the tilting segment which is forcibly controlled in the same direction and/or in the opposite direction relative to the rotating direction of the timing cam, wherein the control device comprises a slider rocker which is guided in the valve lifting direction by way of a first sliding hinge joint arranged on the engine section side and another sliding hinge joint provided on the tilting segment side, and which has a control opening which is penetrated with clearance by a timing-cam-free section of the camshaft, and an element, which can be operated in a controlled manner, of an adjusting device being arranged in/on the camshaft while rotating with the camshaft, is applied to the circumference of the control opening such that the slider rocker being adjustable in the valve lifting direction by the control opening eccentrically to the axis of rotation of the camshaft, while the camshaft is rotating, carries out for each valve lift a periodic rocking movement which forcibly controls the tilting segment and takes place transversely to the valve lifting direction with a superimposition with a sliding movement caused in the valve lifting direction.

2. Valve timing gear according to claim 1, wherein the control opening is radially symmetrically designed with a cylindrical circumference.

3. Valve timing gear according to claim 1, wherein the adjusting device comprises a control shaft coaxially rotatably arranged in a hollow camshaft with an eccentrically arranged control pin interacting with adjusting pins arranged in the camshaft in a diametrically radially movably guided manner, each adjusting pin is in a fixed connection with half a section of a guide ring rotatably disposed in the control opening of the slider rocker.

4. Valve timing gear according to claim 3, wherein one sliding block respectively is arranged between the control pin and the adjusting pin, and each sliding block interacts with the control pin as well as with a respective face of the adjusting pin by way of correspondingly adapted sliding surfaces in a form-locking manner.

5. Valve timing gear according to claim 4, wherein adjacent lifting valves, whose tilting segments are disposed in the tappets, are connected with a pendulum rocker arranged between the tappets, the pendulum rocker being guided in a rocking manner by the tilting segments which is equipped with a straight-guided tilting-segment-side sliding hinge joint in a slot, to which the slider rocker is applied in a hinged manner.

6. Valve timing gear according to claim 3, wherein the camshaft is equipped on one end with an angle-of-rotation adjusting device, and is equipped on an other end for the control shaft with a rotation adjusting device for a continuous rotation adjustment of the control shaft from 0° to 180° and back.

7. Valve timing gear according to claim 1, wherein adjacent lifting valves, whose tilting segments are disposed in the tappets, are connected with a pendulum rocker arranged between the tappets, the pendulum rocker being guided in a rocking manner by the tilting segments which is equipped with a straight-guided tilting-segment-side sliding hinge joint in a slot, to which the slider rocker is applied in a hinged manner.

8. Valve timing gear according to claim 7, wherein the slider rocker on the side of the camshaft away from the valves has a movable connection by a fork-type straight alignment with a sliding block of a sliding hinge joint, the sliding block being angularly movably disposed by a bearing bush on an oil supply pipe fixed on camshaft bearing covers.

9. Valve timing gear according to claim 1, wherein the slider rocker on the side of the camshaft away from the valves has a movable connection by a fork-type straight alignment with a sliding block of a sliding hinge joint, the sliding block being angularly movably disposed by a bearing bush on an oil supply pipe fixed on camshaft bearing covers.

10. Valve timing gear according to claim 6, wherein the straight alignment with the sliding block of the slider rocker as well as a bearing of the sliding block on the bearing bush is arranged in a manner lubricated with oil from the oil supply pipe.

11. Valve timing gear according to claim 1, wherein the lifting valves are actuated by box tappets with hydraulic valve compensating elements, and oil supply ducts provided from oppositely arranged guiding surfaces of each box tappet to the respective hydraulic valve compensating elements are extended beyond the hydraulic valve compensating elements to respective mouths in the circular-arc section which receives the tilting segment in a bearing manner.

12. Valve timing gear according to claim 11, wherein the tilting segment has the contact path constructed on a separate wear-proof part, the separate wear-proof part being in a detachable connection with the tilting segment.

13. Valve timing gear according to claim 1, wherein the tilting segment has the contact path constructed on a separate wear-proof part, the separate wear-proof part being in a detachable connection with the tilting segment.

14. Valve timing gear according to claim 1, wherein the slider rocker has a divided construction in an area of the control opening, for receiving a guide ring constructed with radial flanges and by a lubrication bore extended in the slider rocker beyond the lubricating area of the alignment/sliding block is supplied with oil from the oil supply pipe.

15. Method of making a valve timing gear for an internal-combustion engine, comprising the acts of:

providing a timing cam on a camshaft which acts by a tilting segment in a tappet in a timing manner upon a lifting valve, said tilting segment being constructed with a contact path acted upon by the timing cam and arranged in a movably guided manner by a circular-arc section concentric to the axis of rotation of the camshaft in the tappet, providing a control device whereby during each valve lift, an engagement of the contact path with flanks of the rotating timing cam, which engagement determines opening and closing phases of the lifting valve, is achieved by a swivelling movement of the tilting segment which is forcibly controlled in the same and/or opposite direction relative to the rotating direction of the timing cam, wherein the control device comprises a slider rocker which can be adjusted in the valve lifting direction with the control opening eccentrically to the axis of rotation of the camshaft, such that while the camshaft is rotating, it carries out for each valve lift a periodic rocking movement which forcibly controls the tilting segment and which takes place transversely to the valve lifting direction with a superimposition with a sliding movement caused in the valve lifting direction.

16. A control device for a timing gear of an internal combustion engine comprising, a slider rocker being guidable in a valve lifting direction by a first sliding hinge joint on a first side and by a second sliding hinge joint on a second side, said slider rocker including a control opening having clearance for a camshaft, and an adjusting device being arranged in and on the camshaft and rotating with the camshaft, said adjusting device including an element contacting the circumference of the control opening, wherein the slider rocker is adjusted in the valve lifting direction via the control opening being contacted eccentrically to the axis of rotation of the camshaft, and the slider rocker for each valve lift carries out a periodic rocking movement transverse to the valve lifting direction to forcibly control a contact path of a timing cam upon a lifting valve control.

* * * * *